US010326215B1

(12) United States Patent
Anderson

(10) Patent No.: US 10,326,215 B1
(45) Date of Patent: Jun. 18, 2019

(54) PIN ALIGNING CRIMPING FIXTURE

(71) Applicant: David Martin Anderson, Long Beach, CA (US)

(72) Inventor: David Martin Anderson, Long Beach, CA (US)

( * ) Notice: Subject to any disclaimer, the term of this patent is extended or adjusted under 35 U.S.C. 154(b) by 0 days.

(21) Appl. No.: 16/144,363

(22) Filed: Sep. 27, 2018

(51) Int. Cl.
*H01R 4/10* (2006.01)
*H01R 4/18* (2006.01)
*H01B 7/04* (2006.01)

(52) U.S. Cl.
CPC ..... *H01R 4/186* (2013.01); *H01B 7/046* (2013.01)

(58) Field of Classification Search
CPC ..... H01R 4/18; H01R 4/183; H01R 4/186; H01B 7/046
USPC ..... 439/442, 741, 877
See application file for complete search history.

(56) References Cited

U.S. PATENT DOCUMENTS 4,902,253 A * 2/1990 Schacht ..... H01R 4/62 29/863
5,273,458 A * 12/1993 Fisher, Jr. ..... H01R 9/0518 439/585
6,442,832 B1 * 9/2002 Noble ..... H01R 43/048 174/261
7,927,125 B1 * 4/2011 Zieman ..... H01R 13/73 439/347
2002/0173205 A1 * 11/2002 Kato ..... H01R 13/4367 439/752

* cited by examiner

*Primary Examiner* — Khiem M Nguyen
(74) *Attorney, Agent, or Firm* — Dunlap Bennett & Ludwig PLLC; Brendan E. Squire

(57) ABSTRACT

A splice fixture for holding and crimping a plurality of power pins to a conductor of a submersible pump cable for an electrical connection in a well head. The splice fixture permits the use of standard crimping pliers to crimp the ends of a heavy gauge multi-conductor cables typically used for electric submersible pump (ESP) cables to the power pin for connection to an electrical power source external to the well head.

11 Claims, 6 Drawing Sheets

PIN ALIGNING CRIMPING FIXTURE

BACKGROUND OF THE INVENTION

The present invention relates to electrical connectors, and more particularly to electrical connectors for submersible electric pumps.

In the oil and gas industry, submersible electric pumps are utilized to pump crude oil from within the well head. The environment within the well head in which the pumps and associated electrical conductors operate makes the electrical connections within the wellhead susceptible to corrosion, fatigue, and ultimately disruption of electrical conduction necessary to operate the pumps. The conductors within the well head must also effectively routed to the exterior of the well head to permit connection to an external power source outside to operate the pump.

From time to time, the conductor cables within the well head may require repair or replacement. At other times, the pump may be relocated to a different well head and the conductor cables may be replaced as a precaution to accomplish a fresh installation. The repairs will typically require a splice connection of the conductors. The individual conductors within the heavy gauge multi-conductor cables, typically electrical submersible pump (ESP) cables, are normally oriented in flat side by side configuration. Due to the heavy gauge, the individual conductors in the cables are typically very rigid. Accordingly, adequate separation of the conductors is needed in order to apply a splice with conventional splicing tools. It is also desirable that the crimp be accomplished with standard tools.

As can be seen, there is a need for an improved crimping fixture and method for joining the electrical conductors of and pin conductors of a well head.

SUMMARY OF THE INVENTION

In one aspect of the present invention a splice fixture to facilitate carriage of a plurality of power pins for application of a splice connection between the plurality of power pins and a corresponding conductor of a multi-strand conductor cable, is disclosed. The splice fixture includes an elongate rod to interconnect a first block, a second block, and a pin protector, the first and second block received on a first end of the elongate rod and the pin protector configured to be removably received on a second end of the elongate rod. The first block has a plurality of apertures defined in a radially disposed, spaced apart relation, the plurality of apertures extend through a longitudinal length of the first block. The second block has a plurality of corresponding apertures defined in a radially disposed spaced apart relation and extend through a longitudinal length of the second block. The pin protector also has a plurality of receiving apertures extending into the pin protector, with the plurality of receiving apertures defined in a radially disposed spaced apart relation. The first block and the second block are joinable to secure a crimp end of the plurality of power pins and the pin protector is configured secure a terminal end of the plurality of power pins.

In some embodiments, the plurality of apertures, the plurality of corresponding apertures, and the plurality of receiving apertures are configured to be coaxially aligned to receive the plurality of power pins. The pin protector may be adjustably carried on the elongate rod to accommodate a length of the power pin. The elongate rod may be received in a bore defined in a central axis of each of the first block, the second block, and the pin protector.

In some embodiments, a plurality of axially aligned joining holes are defined through a longitudinal length of each of the first block and the second block. The plurality of axially aligned joining holes are adapted to receive a fastener to join the first and the second blocks. A recess may be defined in an adjacent face of one of the plurality of apertures and the plurality of corresponding apertures. A retaining clip adapted to be received within the recess and have an interior diameter dimensioned to receive the power pin in a close fitting engagement. The plurality of apertures and the plurality of corresponding apertures compressively retain the retaining clip there between when the first block and the second block are joined.

In other embodiments, a fluted opening may be defined in each of the plurality of receiving apertures. The plurality of apertures, the plurality of corresponding apertures, and the plurality of receiving apertures are spaced apart to receive a jaws of a crimping tool.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide a fixture and method of crimping an electrical conductor with a pin connector for a wellhead. The fixture provides radial separation of a plurality of power pins for alignment with a corresponding power conductor so that a splice may be applied to conductively join the conductors and the power pin connector. The spliced connections may then be sealed and carried with the cartridge disclosed in co-pending U.S. Patent Application and mounted within a wellhead.

Figure 1:
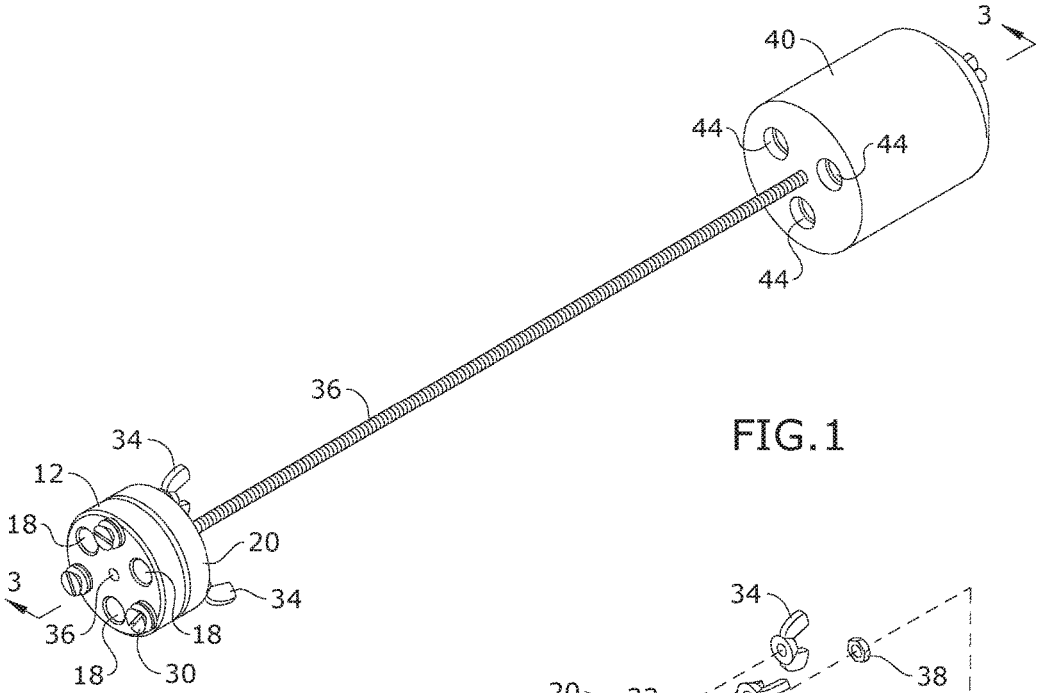
FIG. 1 is a perspective view of and embodiment of a crimping fixture.
Figure 2:
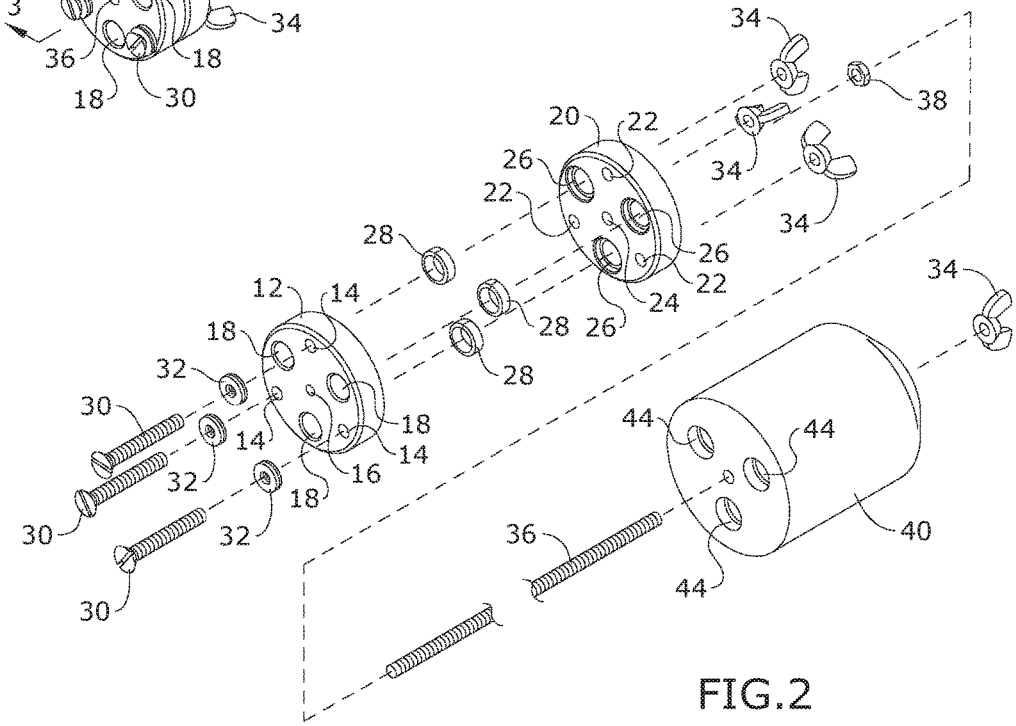
FIG. 2 is an exploded view of the crimping fixture.
Figure 3:
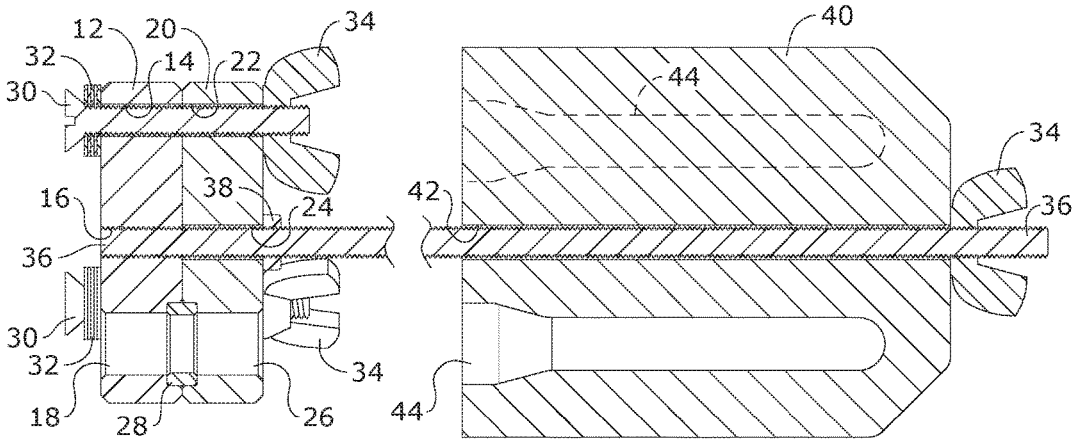
FIG. 3 is a section view of the crimping fixture, taken along line 3-3 in FIG. 1.
Figure 4:
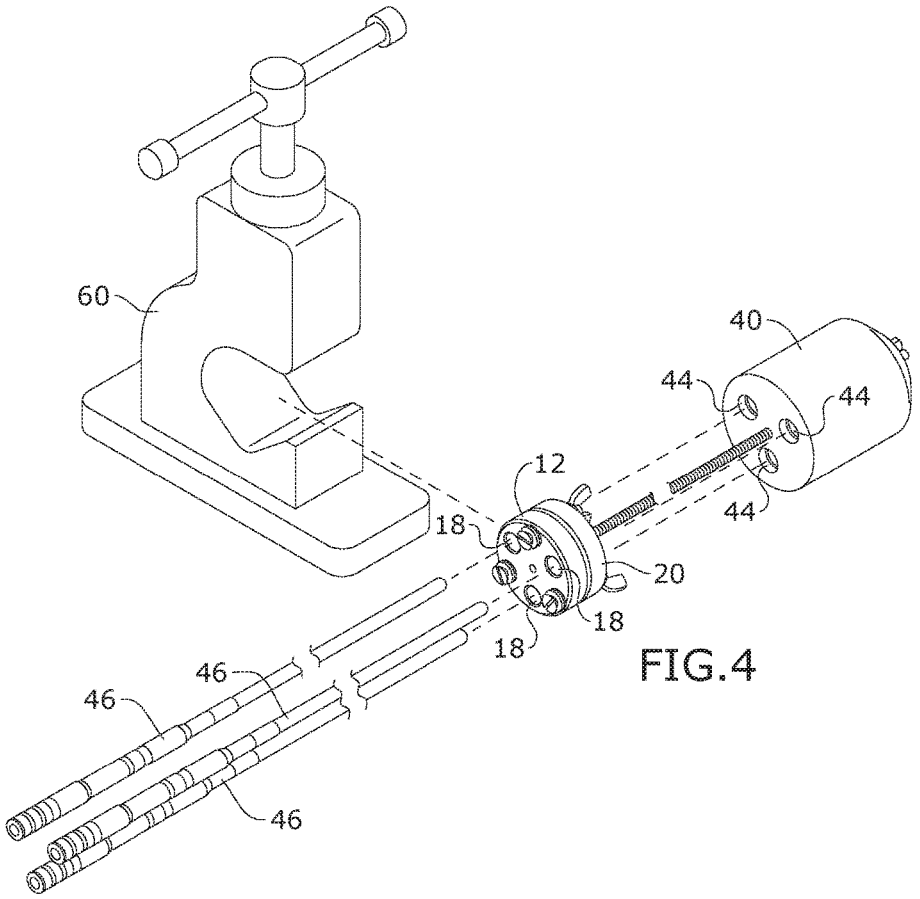
FIG. 4 is a perspective view of the crimping fixture, illustrating the insertion of pins 44 into fixture 10 and the placement of the fixture and power pins into vise 60.
Figure 5:
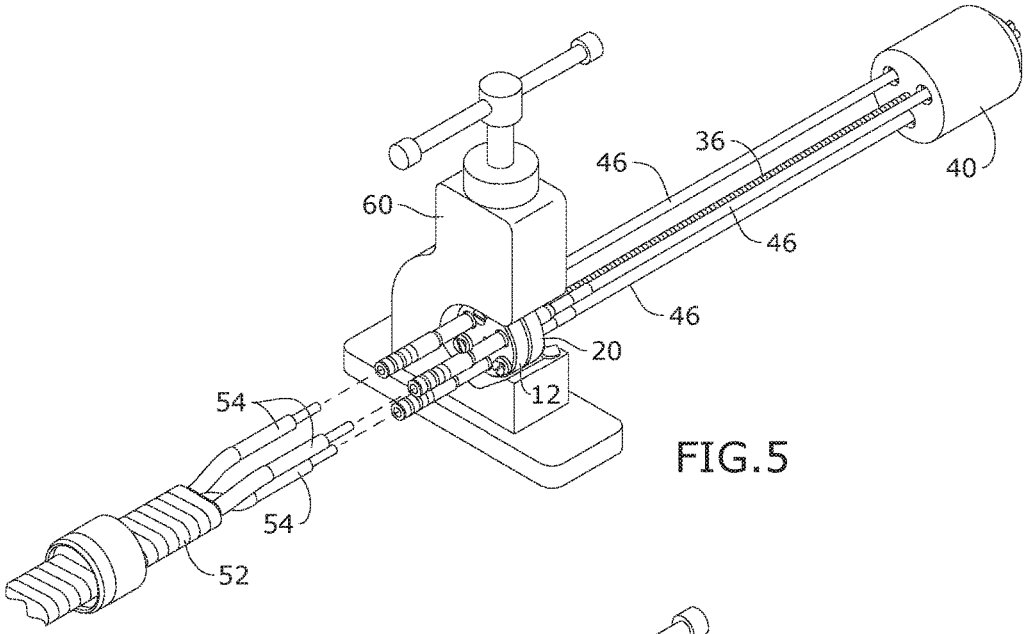
FIG. 5 is a perspective view of the crimping fixture, illustrating the insertion of conductors 54 into connectors 48.
Figure 6:
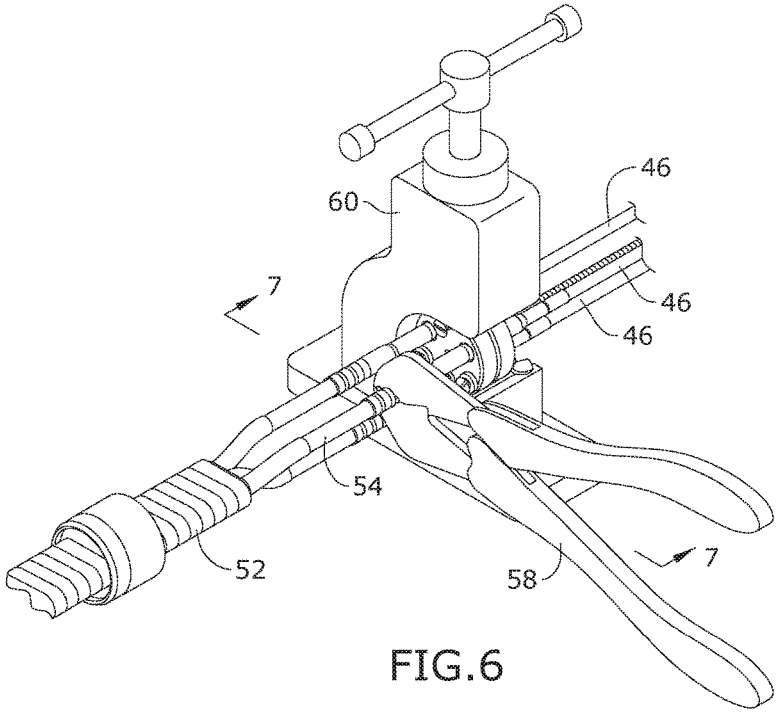
FIG. 6 is a perspective view of the crimping fixture, illustrating the crimping of connectors 48 onto conductors 54.
Figure 7:
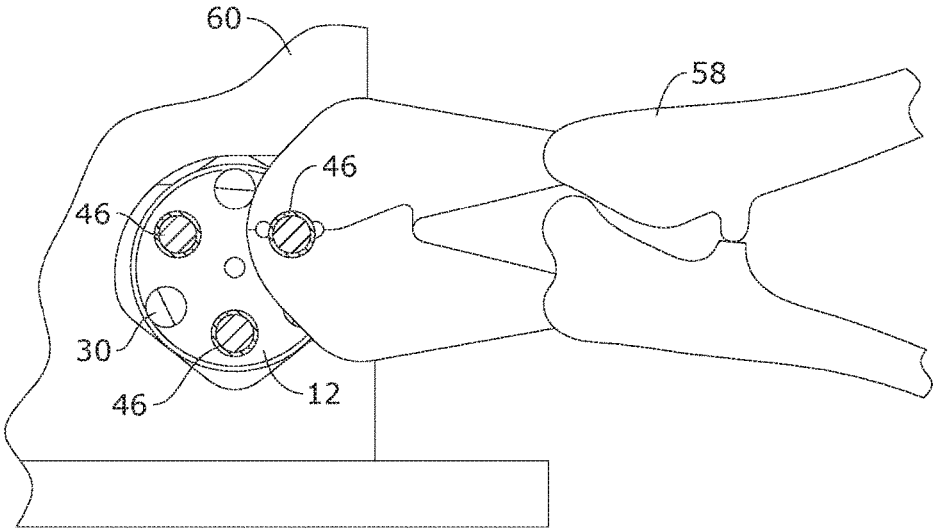
FIG. 7 is a section view of the crimping fixture, taken along line 7-7 in FIG. 6.
Figure 7A:
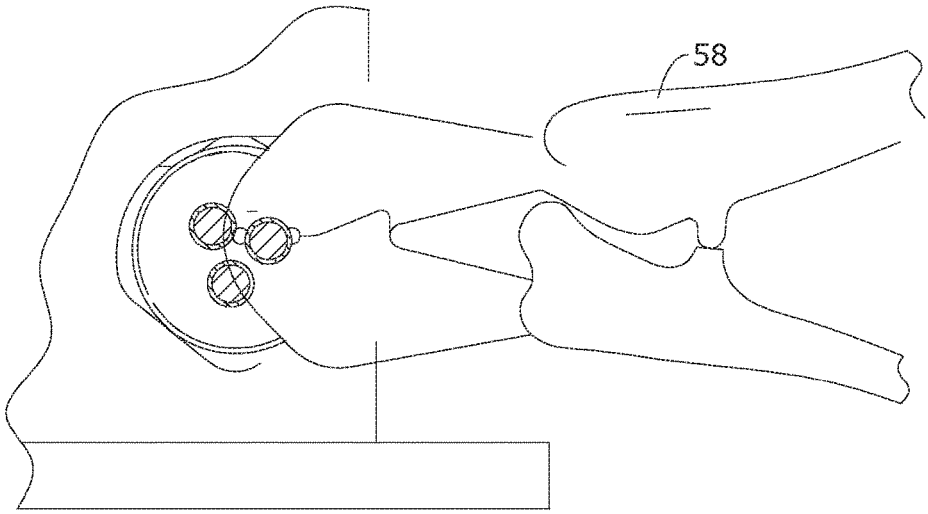
PRIOR ART FIG.7A
FIG. 7A illustrates a view of a prior art crimping connector in use with a standard crimping tool.
Figure 8:
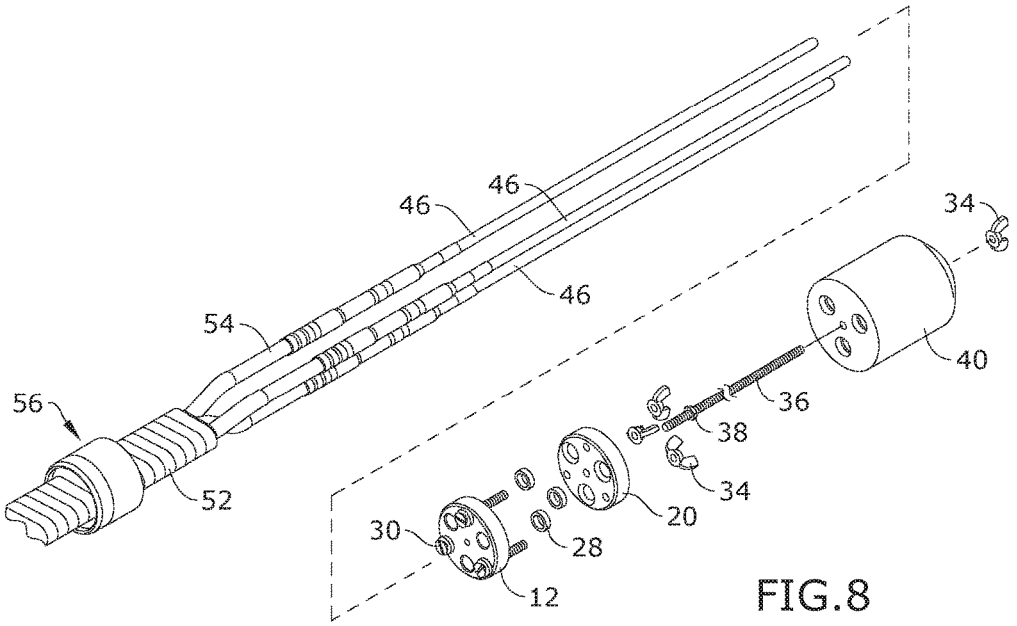
FIG. 8 is a perspective view of the crimping fixture, illustrating the removal of fixture 10 from the cable 52 and pins 46 assembly.

A preferred fixture according to embodiments of the invention is shown in reference to FIGS. 1-3. The fixture includes a first block 12 having a plurality of apertures 18 radially disposed in a spaced apart relationship through a longitudinal length of the block 12. The radially disposed spaced apart relation defining an expanded conductor circle, permitting the jaws of an industry standard crimping tool, such as the to crimp a splice applied to one of the plurality of power pins and a corresponding conductor, without interference with another of the plurality of power pins or conductors.

Each of the plurality of apertures 18 are adapted to receive a power pin 46 for connection to an external power source to provide power to the wellhead pump. The first block 12 is configured to be threadingly carried on an elongate threaded rod 36 through a bore 16 defined through a central axis of the first block 12.

The first block 12 is joined to a second block 20, the second block 20 having a plurality of apertures 26 coaxially aligned with the plurality of apertures of the first block 12. The first block 12 and the second block 20 may be coupled by a plurality of threaded fasteners 30 that are received through axially aligned joining holes 14, 22 in each of the first block 12 and the second block 20. A washer 32 and a nut 34 may be utilized to join the first block 12 and the second block 20.

A retaining clip 28 is provided for each of the power pins and is received in a recess defined in at least one of an adjacent face of the apertures 18, 26. The retaining clip 28 is dimensioned for a close sealing fit around a circumference of the power pin.

As with the first block 12, the second block 20 has a bore 24 defined through a central axis of the second block 20, such that the first and second blocks may be adjustably carried on the elongate threaded rod 36. The bores 16, 36 may be threaded. Alternatively, and adjustment jut 34 may be provided to secure the first and second blocks 12, 20 to a first end of the threaded rod 36.

A pin protector 40 is adjustably carried along the elongate rod 36 from a second end of the rod 36. The pin protector 40 has a plurality of receiving apertures 44 extending into the pin protector. The plurality of receiving apertures 44 are radially disposed in a spaced apart relation to coaxially align with the apertures 18 and 26 of the first and second block 12, 20. The plurality of receiving apertures 44 are dimensioned to receive and protectively cover the ends of the power pins 46 to avoid damage to the ends while the power pins 46 are spliced to the conductors 54. The pin protector 40 is adjustable along the length of the elongate rod 36 so that the crimp fixture may accommodate power pins 46 having differing lengths. The plurality of receiving apertures 46 may have a funneled or fluted opening to facilitate reception of the power pins 46 in the pin protector 40.

A bore 42 extends through a longitudinal axis of the pin protector 46 and is dimensioned to slidingly receive the threaded rod 36. The pin protector 46 is adjustable along the length of the threaded rod 36 via a nut 34.

As seen in reference to FIGS. 5-8, showing the crimping fixture in use, the first block 12 and second block 20 are applied to a crimp end of the power pins 46. The retaining clip 28 may be applied to the power pins 46 prior to assembly of the first and second blocks 12, 29. The pin protector 40 is applied to the free ends of the power pins 46 within receiving apertures 44. The pin protector 40 is adjusted along the length of the threaded rod 36 so that the power pins 46 are held in a radially disposed spaced apart relationship. The joined blocks 12, 20 may be secured in a vise 60 to hold the power pins 46 so that the ends of the conductors 54 of a multi stranded conductor cable 52 may be joined to the power pins 46.

A crimp connector is applied to each of the crimping ends of the power pin 46 and the corresponding conductor 54 is received in each of the crimp connectors. With the power pins 46 and the conductors 54 held in the radially disposed spaced apart relation provided by the crimp fixture, a crimp may be applied by the jaws of a standard crimping tool 58 without interference from another of the plurality of power pins or conductors.

Figure 9:
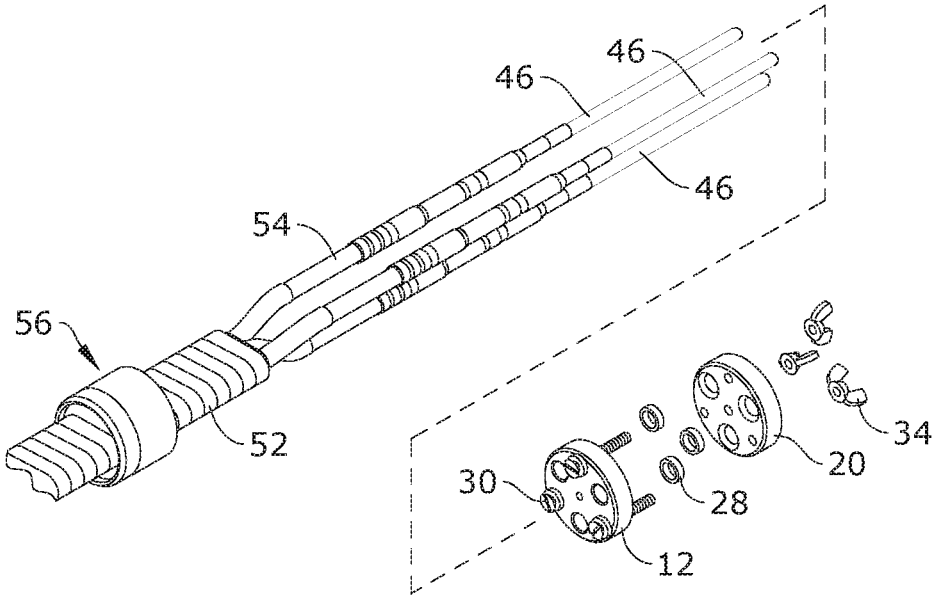
FIG. 9 is a perspective view of the crimping fixture, illustrating the fixture 10 applied to shorter length power pins 46.

Once each of the crimp connectors have been crimped to join the respective power pin 46 and conductor 54, the crimping fixture may be removed from the power pins 46. The joined conductors 54 and power pins 46 may then be encased in a protective cartridge, such as that of our co-pending U.S. Patent Application. For shorter length power pins 46, the threaded rod 36 may be omitted, as seen in reference to FIG. 9. Likewise, the pin protector 40 may be omitted for shorter length power pins 46.

It should be understood, of course, that the foregoing relates to exemplary embodiments of the invention and that modifications may be made without departing from the spirit and scope of the invention as set forth in the following claims.

What is claimed is:

1. A crimping fixture to facilitate carriage of a plurality of power pins for application of a splice connection between the plurality of power pins and a corresponding plurality of conductors of a multi-conductor cable, comprising:

a first block having a plurality of apertures defined in a radially disposed, spaced apart relation allowing a crimping end of an industry standard crimping tool to be positioned around the splice connection between one of the plurality of power pins and a corresponding one of the plurality of conductors without interference with another of the plurality of power pins, the plurality of apertures extending through a longitudinal length of the first block;

a pin protector having a plurality of receiving apertures extending into the pin protector, the plurality of receiving apertures defined in a radially disposed spaced apart relation.

2. The crimping fixture of claim 1, further comprising:

an elongate rod to interconnect the first block, a second block, and the pin protector, the first block received on a first end of the elongate rod and the pin protector received on a second end of the elongate rod;

the second block having a plurality of corresponding apertures defined in a radially disposed spaced apart relation axially aligned with the plurality of apertures of the first block and extending through a longitudinal length of the second block;

wherein the first block and the second block are joinable to secure a crimp end of the plurality of power pins, and the pin protector is configured secure a terminal end of the plurality of power pins.

3. The crimping fixture of claim 1, wherein the plurality of apertures, the plurality of corresponding apertures, and the plurality of receiving apertures are configured to be coaxially aligned to receive the plurality of power pins.

4. The crimping fixture of claim 2, wherein the pin protector is adjustably carried on the elongate rod to accommodate a length of the power pin.

5. The crimping fixture of claim 4, wherein the elongate rod is received in a bore defined in a longitudinal axis of each of the first block, the second block, and the pin protector.

6. The crimping fixture of claim 2, further comprising:

a plurality of axially aligned joining holes defined through a longitudinal length of each of the first block and the second block, the plurality of axially aligned joining holes adapted to receive a fastener to join the first and the second blocks.

7. The crimping fixture of claim 2, further comprising:

a recess defined in an adjacent face of one of the plurality of apertures and the plurality of corresponding apertures.

8. The crimping fixture of claim 6, further comprising:

a retaining device adapted to be received within the recess and having an interior diameter dimensioned to receive the power pin in a close fitting engagement.

9. The crimping fixture of claim 7, wherein the plurality of apertures and the plurality of corresponding apertures compressively retain the retaining device between when the first block and the second block are joined to retain the plurality of power pins in desired axial position.

10. The crimping fixture of claim 1, further comprising:

an opening in each of the plurality of receiving apertures.

11. The crimping fixture of claim 1, wherein the plurality of apertures, the plurality of corresponding apertures, and the plurality of receiving apertures are spaced apart to receive a jaws of an industry standard crimping tool around a splice connection between one of the plurality of power pins.

* * * * *